United States Patent [19]

Loepfe et al.

[11] 4,228,828

[45] Oct. 21, 1980

[54] ELECTRONIC THREAD MONITORING DEVICE FOR GRIPPER SHUTTLE WEAVING MACHINES

[75] Inventors: Erich Loepfe, Pfaffhausen; Erich Weidmann, Wetzikon, both of Switzerland

[73] Assignee: Gebrüder Loepfe AG, Zürich, Switzerland

[21] Appl. No.: 956,277

[22] Filed: Oct. 30, 1978

[30] Foreign Application Priority Data

Nov. 1, 1977 [CH] Switzerland ..... 13374/77

[51] Int. Cl.[2] ..... D03D 51/34

[52] U.S. Cl. ..... 139/370.2; 139/370.1

[58] Field of Search ..... 139/336, 370.1, 370.2; 73/159, 160; 250/571, 572; 340/675, 677; 66/163

[56] References Cited

U.S. PATENT DOCUMENTS

| | | | |
|---|---|---|---|
| 3,489,910 | 1/1970 | Bohme et al. | 139/370.2 |
| 3,676,769 | 7/1972 | Loepfe | 139/370.2 |
| 4,031,924 | 6/1977 | Domig et al. | 139/336 |

FOREIGN PATENT DOCUMENTS

| | | | |
|---|---|---|---|
| 399354 | 9/1965 | Switzerland | 139/370.2 |
| 489642 | 4/1970 | Switzerland | 139/370.2 |
| 580533 | 7/1974 | Switzerland | 139/336 |
| 583656 | 1/1977 | Switzerland | 139/336 |
| 539996 | 2/1977 | U.S.S.R. | 139/370.2 |

*Primary Examiner*—Henry Jaudon

*Attorney, Agent, or Firm*—Werner W. Kleeman

[57] ABSTRACT

The invention is concerned with an electronic weft or filling thread monitoring device on a gripper shuttle weaving machine provided with means for moving the gripper shuttle, at the end of the shuttle insertion, back from a stop position to a yarn releasing position, and simultaneously tensioning the thread. The monitoring device comprises thread sensing means responsive to thread travel as well as to thread tensioning and provides machine stopping signals when neither continuous thread travel nor thread tensioning occurs in predetermined, machine-controlled monitoring intervals.

6 Claims, 18 Drawing Figures

Fig. 5
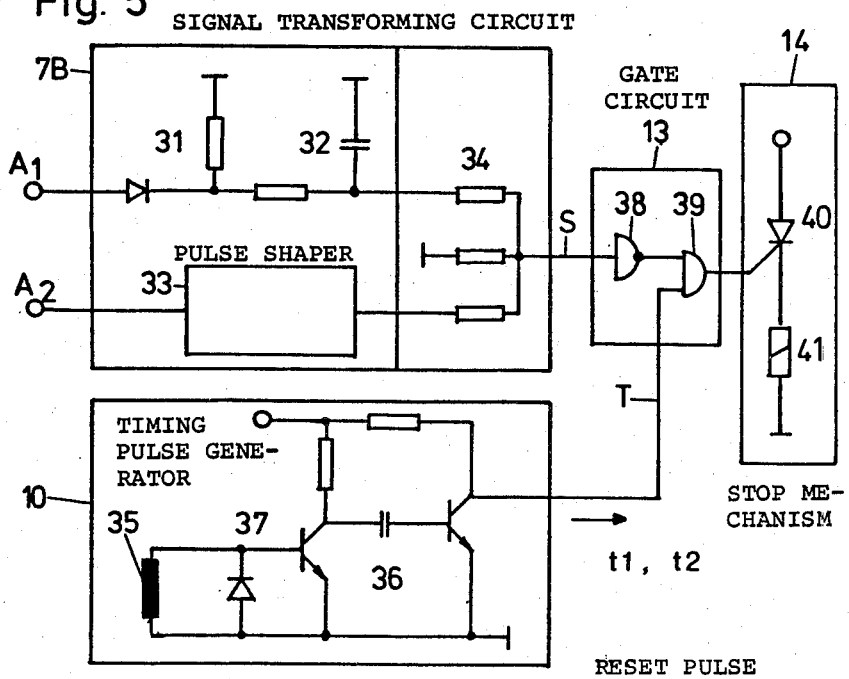
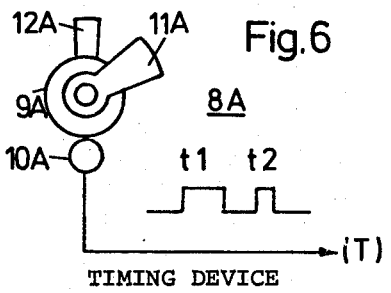
Fig.6
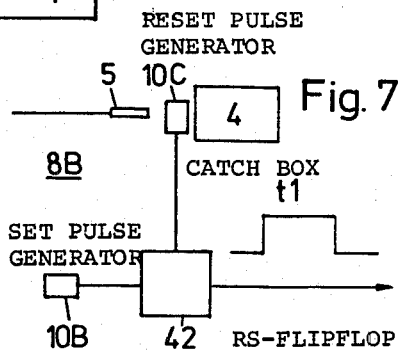
Fig. 7
Fig. 9
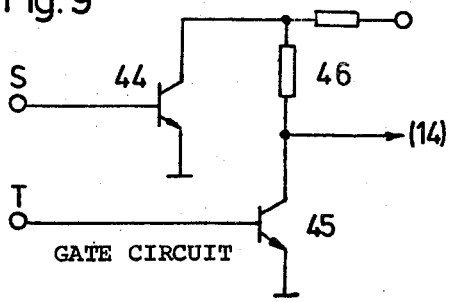
Fig. 8
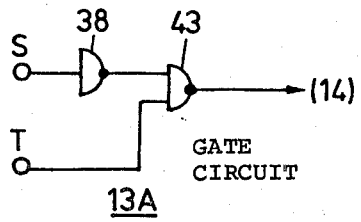

ELECTRONIC THREAD MONITORING DEVICE FOR GRIPPER SHUTTLE WEAVING MACHINES

BACKGROUND OF THE INVENTION

The present invention relates to a new electronic weft or filling thread monitoring device on a gripper shuttle weaving machine or loom provided with means for returning, after thread insertion, the gripper shuttle from a stop position to a defined thread releasing position, and simultaneously tensioning the thread.

This new thread monitoring device comprises a device for sensing the weft or filling thread at the picking side of the weaving machine, a timing pulse generator actuated by the weaving machine, and a gating circuit operatively connected to the sensing device and the timing pulse generator, the gating circuit being locked for the output of the timing pulse generator as long as the sensing device produces a sensing signal indicative of proper thread insertion.

An electronic weft or filling thread monitor of the aforementioned type is disclosed by Swiss Pat. No. 437,163. This monitor comprises a thread sensing device arranged on the picking side of the weaving machine, following a thread tensioner, however outside the range thereof, and in advance of the selvedge of the textile web. The thread sensor is provided with a sensing pin or lever which is deflected or bent, during the tensioning or returning motion of the thread, by the transverse component of the tension exerted by the laterally deflected thread. The deflection of the thread is transformed into an electrical sensing signal indicative of an intact thread.

German patent publication No. 1,535,615 refers to another weft or filling thread monitor comprising, as a sensing element, a pivotable lever or rotatable roller arranged on the picking side antecedent to the thread tensioner, any motion of the sensing element being detected by optical means. This monitor responds to the so-called pull after motion occurring when the thread tensioner draws a short thread end off a supply spool and through the tensioner during the tensioning motion. Thus, a possible tensioning of the thread without longitudinal motion thereof does not result in a signal.

It is to be stated that the aforementioned thread monitors having a mechanical sensing element actuated by the weft or filling thread are affected by some inertia.

Moreover it is known to monitor the thread during insertion thereof into the waving shed. An electronic monitor designed for this purpose and comprising a sensing element arranged on the picking side is shown in Swiss Pat. No. 489,642 or U.S. Pat. No. 3,676,769. When the thread breaks during weft insertion, the monitor causes stopping the weaving machine. Electronic monitors of this type or thread insertion monitors by now are in widespread use. They are simple in construction and reliable in rugged long time operation. They also have sensing devices, such as triboelectrical sensors, which are substantially inertialess. Such sensors, by way of example, are disclosed in both last mentioned patents.

Due to the complicated operation of the gripper shuttle weaving machines, as compared with conventional weaving looms, the aforementioned known weft or filling thread monitors were not able to meet all desirable demands. In order to illustrate this situation, the intervals or phases of weft or filling thread insertion will be defined, and the occurring difficulties will be discussed in the following. As for the construction and operation of gripper shuttle weaving machines, both first mentioned patents are relevant.

The weft or filling thread insertion, prior and up to the controlled release of the thread from the gripper shuttle or projectile may be divided into three phases:

First phase: from picking the shuttle up to entering the receiving or catch box. The time interval of this phase, in the present context called insertion or weft insertion, depends upon the weaving width and may be, by way of example, 120 ms;

Second phase: time of shuttle braking and standstill in catch box. This "catch phase" is very short, and comprises, e.g., 10 ms;

Third phase: tensioning operation of thread tensioner and pulling back shuttle from stop position to thread release position in catch box. This "tensioning phase" may comprise 70 ms.

From experience, most of the thread breaks occur in the first and third phases, due to increased thread tension.

Particularly in the second phase, with the catch brake acting upon the projectile, the end of the inserted thread may prematurely be released from the projectile. Namely, due to strong deceleration forces, the pressure exerted by the thread clamping spring in the projectile may decrease to such a degree that the thread end is dropped (so-called looser). Moreover, when the thread brake is loosely adjusted, or loosened during operation, the projectile may hit the rear abutment of the breaking device in the catch box, also tending to release the thread end from the projectile (so-called rebounds).

All these various events are termed "thread breaks" in the following description. Since the aforesaid events result in fabric faults, they should be detected by a weft or filling thread monitor as completely as possible. That means, reliable thread monitoring should comprise thread insertion up to the end of the third phase, i.e. the tensioning phase. The very problem results from the difficulty to monitor the tensioning phase in such a manner that thread breaks are signalled safely and in time. This problem, due to the particular mode of operation of the gripper shuttle weaving machine, hitherto has not been solved satisfactorily.

When the projectile is being braked in the second phase, the thread slightly overshoots, because of the inertia thereof, tending to form so-called coilings in the thread end near the catch box. Since the thread brake arranged on the picking side is controllable, the undesired overshooting may be reduced, by increasing the braking effect, in such a manner that in the third phase this thread end is just sufficiently tensioned in the weaving shed. Then, during the tensioning motion there normally exists such a low thread tension that, when the thread is sensed between thread tensioner and weaving shed by known means, insufficient sensing signals are produced. This is also true in the above mentioned known case that the pull after motion is sensed between thread brake and thread tensioner, since only little or no thread is drawn from the supply coil through the thread brake.

These difficulties exist not only when using the above mentioned known weft or filling thread monitors provided with mechanical sensing elements, but also with electronic thread monitors having inertialess sensing elements mainly responsive to thread travel. This disadvantage might be partly avoided by increasing the effect of the thread brake; this, however causes further yarn breaks because of the increased thread tension, and thus reduces the efficiency of the machine.

SUMMARY OF THE INVENTION

Thus, it is a main objective of the invention to provide an improved electronic weft or filling thread monitoring device for a gripper shuttle weaving machine.

It is a further more specific object of the invention to procure an electronic device for safely monitoring, on a gripper shuttle weaving machine, the first or insertion phase, as well as the third or tensioning phase.

These objectives are realized by the inventive electronic weft or filling thread monitor which comprises means arranged at the picking side of the weaving machine for sensing the weft or filling thread and producing a first signal indicative of thread travel and a second signal indicative of thread tensioning;

means actuated by the weaving machine for generating a first timing pulse within the weft or filling thread insertion interval, and a second timing pulse within a returning interval;

gating means controlled by said first and second signals and first and second timing pulses, for generating a stop signal when no first or second signal exists during the first and second timing pulses, respectively.

BRIEF DESCRIPTION OF THE DRAWINGS

The invention will be better understood and objects other than those set forth above will become apparent upon consideration of the following detailed description thereof which refers to the annexed drawings wherein:

FIG. 5 shows further electronic circuits of the monitor represented in FIG. 1, in detailed representation;

FIG. 6 illustrates a modified embodiment of the timing device as shown in FIG. 1;

FIG. 7 represents a third embodiment of the timing device;

FIGS. 8 and 9 are diagrams of gate circuits modified with repect to FIG. 5, in logic symbol and electronic circuit component representation, respectively;

DETAILED DESCRIPTION OF THE INVENTION

FIG. 1: CONSTRUCTION AND ARRANGEMENT OF THE MONITOR ON THE WEAVING MACHINE

Figure 1:
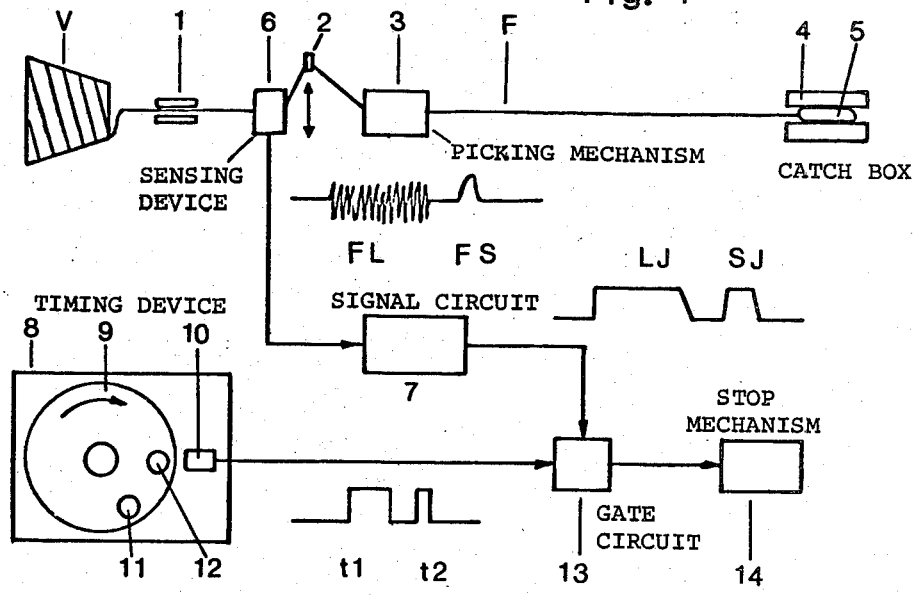
FIG. 1 shows, in schematic and simplified representation, a weft or filling thread monitor including electronic circuits in block diagram, and some componenets of a gripper shuttle weaving machine.

With reference to FIG. 1, there are shown those components of the weaving machine which are essential for understanding the invention: a controllable thread brake 1, a thread tensioner 2 operating in the direction of the double arrow, a picking mechanism 3 on the picking side of the weaving machine, and a catch box 4 with a gripper shuttle or projectile 5 therein arranged on the catching side of the machine. On the picking side antecedent or forwardly of the thread brake 1 there is arranged a weft supply bobbin or spool V from which the weft or filling thread F is pulled off. A thread sensing device 6 of the monitoring device is mounted on the weaving machine between thread brake 1 and thread tensioner 2.

Guide means (not shown) for the gripper shuttle 5 are provided between picking mechanism 3 and catch box 4. Moreover, FIG. 1 shows, between picking mechanism 3 and catch box 4, the weft or filling thread F as inserted and tensioned within the weaving shed. Thread brake 1, thread tensioner 2, picking mechanism 3 and catch box 4 are controlled, according to a predetermined program, by the drive mechanism of the weaving machine, whereby the braking action of thread brake 1 varies periodically and thread tensioner 2 is periodically moved up and down. Details concerning the construction and mode of operation of such a weaving machine may be seen from the above mentioned letters patents.

FIG. 1 shows, in the operating cycle of the weaving machine, the instant after thread insertion when projectile 5 has been returned into the thread releasing position, and thread F inserted in the weaving shed is withdrawn by thread tensioner 2 and slightly tensioned.

The weft or filling thread monitor comprises the thread sensing device 6, also termed sensing head in the following description, an electronic signal circuit 7 operatively connected to the sensing head 6, a timing device 8, a gate circuit 13 and a mechanism 14 for stopping the weaving machine upon yarn or thread breaks. All these parts are preferably mounted on the weaving machine, however, signal circuit 7 together with gate circuit 13 may be arranged outside the weaving machine.

Timing device 8 comprises a disc 9 synchronously rotatable with the drive of the weaving machine, and two permanent magnets 11, 12 attached to disc 9 adjacent the rim and adjustable in peripheral direction thereof. Near the path of permanent magnets 11, 12 there is mounted on the weaving machine a pulse generator 10 generating first and second timing pulses t1 and t2 each time permanent magnets 11, 12 pass by pulse generator 10, in such a manner that the first timing pulse t1 occurs shortly before the end of the insertion or first phase, and the second timing pulse t2 occurs shortly after the commencement of the third phase in which thread tensioner 2 is moving upward.

THE SENSING SIGNALS IN THE FIRST, SECOND AND THIRD PHASES

Immediately prior to insertion, projectile 5 is contained in picking mechanism 3, the end of weft or filling thread F being clamped by the above mentioned clamping spring (not shown) in projectile 5. In all phases, thread F passes thread sensing device 6. By picking projectile 5 out of picking mechanism 3, thread F is inserted into the weaving shed causing thread sensing device 6 to generate a first thread sensing or travel signal FL in the shape of an A.C. voltage pulse. Projectile 5 will be braked when entering catch box 4, finishing the first phase at the moment when thread tensioner 2 assumes its lowest position. The thread sensing signal returns to zero in the following second phase during which projectile 5 is coming to a standstill in its outermost right position, i.e. the stop position.

During the tensioning phase with thread tensioner 2 moving upward, the thread brake 1 clamps the weft or filling thread F, and only a short thread end is drawn from supply bobbin V when the thread is properly inserted. Thread sensing device 6 responds to the thread tension caused by the upward motion of thread tensioner 2 by furnishing a thread tensioning signal FS in the shape of a short pulse with respect to the interval of thread travel signal FL.

The terms "of high frequency" referring to the thread travel signal FL and "of low frequency" referring to the thread tensioning signal FS in the following context are meant to express the fact that the first cited signal FL comprises a greater portion of higher frequencies than signal FS. In order to indicate this difference, signals FL and FS are drawn in a somewhat simplified shape in FIG. 1.

The further processing of sensing signals FL and FS as well as timing signals t1 and t2 will still be explained in detail with reference to FIGS. 4 and 5.

CONSTRUCTION AND OPERATION OF THE THREAD SENSING DEVICE, FIGS. 2-4

The thread sensing device 6 may comprise a single sensing head provided, by way of example, with a piezoelectrical or triboelectrical transducer system. Triboelelctrical sensing heads and transducer systems are disclosed in Swiss Pat. Nos. 479,478 and 583,656, by way of example.

However, with such a single sensing head it is not possible to obtain, without further measures, signal amplitudes for both of said sensing signals FL, FS large enough relative to the noise level. This difficulty results from the travel signal FL mainly being of high frequency character, whereas the tensioning signal FS is of mainly low frequency nature.

In the following description a sensing head 16 provided with a single piezoelectrical transducer system is described with reference to FIGS. 2-4. In sensing head 16, there is additionally arranged part of the signal circuit 7, namely a separating circuit 7A, FIG. 4, whereas the remaining part of signal circuit 7, termed signal transforming circuit 7B, FIG. 5, is arranged outside sensing head 16. The latter furnishes, at separate output terminals A1, A2, FIG. 4, a travel signal FL and tensioning signal FS, respectively.

Figure 2:
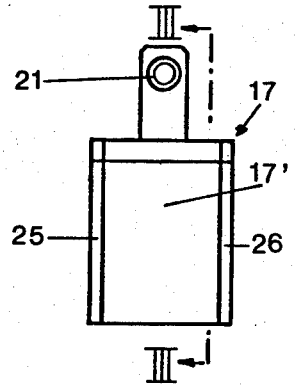
FIGS. 2 and 3 show a first embodiment of a thread sensing head in front view and cross-sectional view along the line III—III in FIG. 2, respectively.
Figure 3:
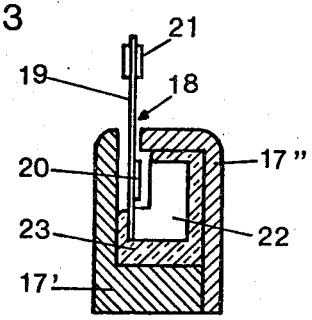

Sensing head 16 as shown in front view in FIG. 2, and in FIG. 3 in cross-secional view along line III—III of FIG. 2, comprises a casing 17, a vibratable transducer system 18, a transducer system support shaped as a block 22, and rubber elastic bedding or support material 23 between casing 17 and block 22. Transducer system 18 comprises a sensing lever or arm 19 formed as a cantilever or leaf spring made of metal and a piezoelectrical element 20 shaped as a rectangular plate or lamina soldered or cemented to sensing lever 19. A ring-shaped thread guide 21 made of ceramics is fastened to the free end of sensing lever 19. The lower end of sensing lever 19 is fixedly attached to block 22. This contruction of the sensing head is based on the teachings of Swiss Pat. No. 580,533. Additionally, the electronic separating circuit 7A shown in FIG. 4 is contained in block 22. For the sake of clarity, the necessary electrical connections and terminals are not shown in FIGS. 2 and 3.

Casing 17 consists of a front shell 17', a rear shell 17" and two end walls 25, 26. Block 22 which is supported in casing 17 by means of soft elastic and vibration absorbing support material 23, e.g. sponge or foam rubber, acts like a seismic mass and forms, together with the support material 23, a heavily damped vibratory system of very low natural frequency. Thus, ambient vibrations and impacts which might emanate from the weaving machine, and be transferred to casing 17 are prevented from affecting the piezoelectrical transducer system 18. This characteristic is essential for gererating thread sensing signals FL and FS having sufficiently large signal to noise ratios.

Figure 4:
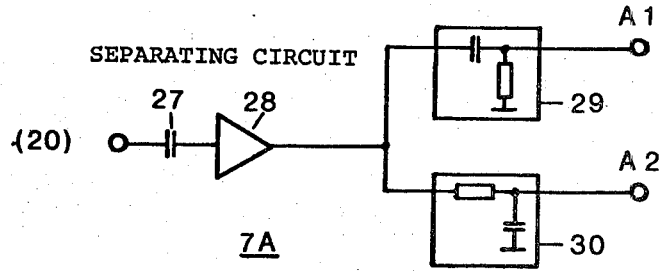
FIG. 4 shows an electronic circuit which is part of the sensing head of FIGS. 2 and 3.

With reference to FIG. 4, the electronic components of separating circuit 7A contained in block 22 comprise a coupling capacitor 27 which connects the piezoelectrical element 20 to the input of an amplifier or preamplifier 28, a high-pass filter 29 and a low-pass filter 30 connected in parallel to the output of amplifier 28. The output A1 of high-pass filter 29 furnishes a thread travel signal FL of high frequency, whereas the output A2 of low-pass filter 30 provides a thread tensioning signal FS of low frequency. Thus, the sensing signals FL and FS are separated from one another by the filters 29 and 30.

THE FURTHER ELECTRONIC CIRCUITS OF THE WEFT OR FILLING THREAD MONITOR, FIG. 5

FIG. 5 illustrates the structure of the further functional units 7B,10,13 and 14 of the electronic weft or filling thread monitor which are shown in FIG. 1 in block schematic.

The electronic signal transforming circuit 7B which is arranged apart from sensing head 16 has two inputs which are connected to the outputs A1 and A2, respectively, of separating circuit 7A contained in sensing head 16. A series arrangement comprising a rectifier stage 31 and a smoothing stage 32 is connected to output A1. Rectifier stage 31 and smoothing stage 32 together with amplifier 28 and high-pass filter 29 form a first signal channel. Both stages 31 and 32 together transform the travel signal FL of high frequency into a travel pulse LJ, FIG. 1. A first pulse shaper 33 is connected to output A2 for transforming the thread tensioning signal FS into a substantially rectangular tensioning pulse SJ. Pulse shaper 33 may be structured, by way of example, as a two stage transistor amplifier. Amplifier 28, low-pass filter 30 of FIG. 4 and pulse shaper 33 of FIG. 5 form a second signal channel.

In the output stage 34, travel pulse LJ and tensioning pulse SJ are brought together. Output stage 34 is designed as a simple summing circuit, and is not an indispensable component of the circuitry since the function thereof may also be taken over by the following gate circuit 13.

Timing pulse generator 10 comprises an induction coil 35 cooperating with the permanent magnets 11, 12, FIG. 1, a second pulse shaper 36 connected to induction coil 35, and a rectifying diode 37 in parallel relationship to induction coil 35 for short-circuiting and thus eliminating the negative going portions of the pulses delivered by said coil 35.

Shortly prior to the end of the first phase and when the first permanent magnet 11, FIG. 1, passes by, timing pulse generator 10 produces a first rectangular pulse, that is, the timing pulse t1, and when the second permanent 12 passes by in the tensioning phase, a second shorter timing pulse t2. The duration of these timing pulses is dimensioned shorter than the durations of the sensing pulses LJ and SJ such that the timing pulses, regarding the time deviations which normally occur in the working cycle of the weaving machine, safely occur within the time intervals defined by the sensing pulses LJ and SJ.

Gate circuit 13 comprises a negator 38 and an AND-gate 39, a sensing signal input S and a timing signal input T. Input S of negator 38 is connected to the output of output stage 34, and the output of negator 38 is connected to a first input of AND-gate 39. The second or T input of AND-gate 39 is connected to the output of timing pulse generator 10.

Stop mechanism 14 comprises a semiconductor controlled rectifier 40 and a relay 41 in series connection and energized by a positive voltage. The control input of semiconductor controlled rectifier 40 is connected to the output of gate circuit 13. Normally, i.e. when the output of gate circuit 13 is zero, rectifier 40 blocks the current flow through relay 41 which remains de-energized.

With correct weft insertion during the first through third phases, a sensing pulse LJ or SJ at input S occurs simultaneously with each of the timing pulses t1 or t2, respectively, appearing at input T of gate circuit 13. The positive going sensing pulses LJ are transformed into zero pulses by negator 38. These zero pulses lock AND-gate 39 to the timing pulses t1,t2 so that the stop mechanism 14 is not actuated and the weaving machine continues working. However, when one of the sensing pulses LJ, SJ does not appear, the associated timing pulse t1 or t2, respectively, can pass AND-gate 39 so that rectifier 40 is unlocked, relay 41 is actuated and the weaving machine is stopped.

The weft or filling thread monitor shown in FIGS. 1–5 may be modified in various respects. Thus, the electrical filters 29 and 30 shown in FIG. 4 may be united with the signal transforming circuit 7B of FIG. 5 and then are preferably assembled therewith, gate circuit 13 and a not shown supply unit furnishing the necessary electrical voltages, in a switching box. Eventually, the first pulse shaper 33 may be omitted, e.g., when the tensioning pulses FS furnished by sensing head 16 can be processed without transforming them.

The pulse shapers 33, 36 may be designed, by way of example, as monoflops or monostable circuits, each furnishing a timing pulse t1 or t2, respectively, of predetermined duration when triggered. Further modifications and variants of the electronic switching units and sensing head are illustrated in the following context referring to further Figures.

With reference to FIG. 6, the timing device 8A differs from timing device 8 shown in FIG. 1 by two vanes 11A, 12A provided in place of the permanent magnets 11, 12, which vanes 11A, 12A are mounted on a rotatable disc 9A adjustable in peripheral direction thereof. Timing pulse generator 10A is arranged such that it is covered by the passing by vanes 11A, 12A.

Timing pulse generator 10A may comprise a proximity switch or Reed relay whose contacts are closed by the vanes 11A, 12A which, with this embodiment, are made of a magnetic material. Alteratively, timing pulse generator 10A may comprise an oscillator circuit provided with a coil whose inductivity is damped by the passing by vanes 11A, 12A which should be made of metal. In other embodiments, timing pulse generator 10A may be provided with an optoelectrical transducer, or a known Hall generator as a contactless switch.

The duration of the timing pulses t1, t2 provided by timing device 8A shown in FIG. 6 depends upon the width of the vanes 11A, 12A. Here, vane 11A is broader than vane 12A so that the first timing pulse t1 is longer than the second timing pulse t2. Usually only the second half of the weft insertion, i.e. from the middle of the weaving shed up to the catch box 4 is monitored. Accordingly, the width of vane 11A is chosen such that the duration of the first timing pulse is smaller than the duration of the travel signal FL, and vane 11A is adjusted in peripheral direction such that pulse t1 occurs within the time interval of FL. The time relation of the second timing pulse t2 to tensioning signal FS is analogous.

FIG. 7 shows a modified timing device 8B comprising two pulse generators 10B, 10C, and a RS-flipflop 42 controlled by these pulse generators for producing a first timing pulse t1. Set pulse generator 10B co-operates, in a similar manner as does timing pulse generator 10, FIG. 1, with a single permanent magnet 11 attached to a rotating disc 9. Reset pulse generator 10C is arranged adjacent the path of the projectile 5 immediately antecedent to catch box 4 such that projectile 5 does not trigger a reset pulse when entering catch box 4. The output pulse of RS-flipflop 42, that is the first timing pulse t1, commences with the set pulse from generator 10B and ends with the reset pulse from generator 10C. Thus, timing device 8B, FIG. 7, furnishes a first timing pulse t1, the end of which is exactly timed to the end of the weft insertion. The second timing pulse t2 may be triggered by the trailing edge of the first timing pulse t1, through a not shown intermediate circuit effecting a delay of some milliseconds.

In FIGS. 8 and 9 there is shown a variant circuit 13A of gate circuit 13 which may be used when a negative-going stop pulse is required instead of a positive-going one. The gate circuit 13A, FIG. 8, comprises a negator 38 and a NAND-gate 43. FIG. 9 illustrates the design of gate circuit 13A comprising two transistors 44, 45 in grounded emitter arrangement, the collectors of the transistors being coupled to each other by a resistor 46. The base of the first transistor 44 is supplied, through input S, with the sensing pulses LJ, SJ from signal circuit 7, FIG. 1, whereas the base of the second transistor 45 receives the timing pulses t1, t2 over input T. Normally the output signal of gate circuit 13A is a logic H-signal and becomes a logic L-signal when an L-signal exists at input S and an H-signal at input T. The weaving machine is stopped when a logic L-signal appears at the output terminal of 13A.

FIGS. 10–17 show thread sensing devices provided with two electrically separated transducer systems, the first transducer system furnishing the thread travel signal FL, and the second transducer system the thread tensioning signal FS. An individual signal channel is connected to each of the transducer systems. These signal channels may be designed similar to the one shown in FIGS. 4 and 5, however with the difference that an individual input stage, such as amplifier 28, FIG. 4, is provided for each transducer system.

Figure 10:
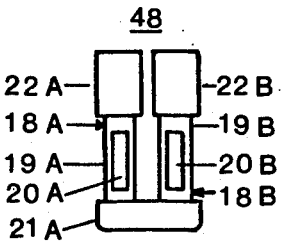
FIGS. 10 and 11 show, in schematic representation, a piezoelectrical thread sensing device comprising two transducer systems, in front and side view, respectively.
Figure 11:
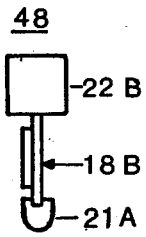

FIGS. 10 and 11 show, in front view and side elevation, a thread sensing device 48 comprising two piezoelectrical transducer systems 18A, 18B provided with pendent vibratable sensing levers or arms 19A and 19B, respectively, to each of which there is attached a piezoelectrical element 20A and 20B, respectively. In a similar manner as described above with reference to FIGS. 2 and 3, each sensing arm 19A and 19B is fixed to a rigid block 22A and 22B, respectively. The free lower ends of the sensing arms 19A, 19B are mechanically coupled with each other by a common thread guide 21A. An individual pre-amplifier (not shown) corresponding to amplifier 28, FIG. 4, is connected to each of the piezoelectrical elements 20A, 20B. Thread sensing device 48 may be supported in a casing in a similar manner as described above with referece to FIGS. 2 and 3.

It is an essential feature of thread sensing device 48 that both the mechanical vibratory systems, each of which comprises a sensing arm 19A or 19B, and a piezoelectrocal element 20A or 20B, respectively, are differently tuned; the one vibratory system comprising the components 19A and 20A has a high natural frequency for generating the thread travel signal FL, and the other vibratory system comprising the components 19B and 20B has a low natural frequency for generating the thread tensioning signal FS.

Figure 12:
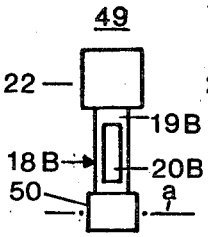
FIGS. 12 and 13 show a thread sensing device in which a triboelectrical transducer system is combined with a piezoelectrical transducer system, in front and lateral view, respectively.
Figure 13:
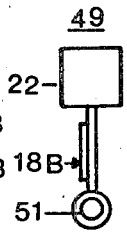

The thread sensing device 49 represented by FIGS. 12 and 13 comprises a first triboelectrical transducer system 50 which is ring-shaped and simulataneously functions as a thread guide, and a second piezoelectrical transducer system 18B structured in a similar manner as the transducer system 18B which is tuned at a low frequency and shown in FIGS. 10 and 11. The triboelectrical transducer system 50 is provided with a longitudinal bore 51 and serves for generating the travel signal FL of high frequency, whereas the piezoelectrical element 20B furnishes the low frequndy tensioning signal FS. The longitudinal axis a of the ring-shaped triboelectrical transducer system 50 is arranged in the plane defined by the plate-shaped sensing arm 19B and perpendicular to the longitudinal extension thereof.

Figure 14:
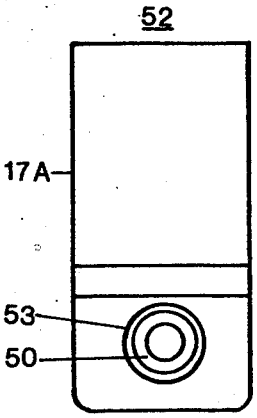
FIGS. 14 and 15 show another thread sensing head in front view and lateral cross-sectional view.
Figure 15:
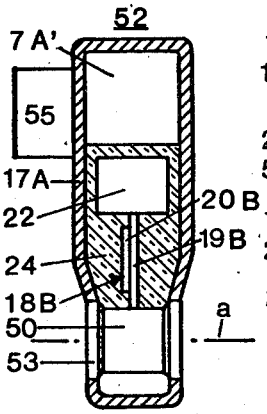

FIGS. 14 and 15 show a sensing head 52 in front view and cross-sectional side elevation. Two transducer systems 18B, 50 are provided which are designed in a similar manner as those shown in FIGS. 12 and 13, however, the axis a of the ring-shaped transducer system 50 extends in a direction perpendicular to the major faces of sensing arm 19B. The transducer systems 18B, 50 together with block 22 and an electronic input circuit 7A' are supported in a closed casing 17A, the lower part of which is provided on both sides thereof with holes or bores 53 arranged coaxially with triboelectrical transducer system 50 as shown in FIG. 14. The transducer systems 18B, 50 and block 22 are supported in casing 17A by a soft elastic support material 24, e.g. elastic rubber cement. A rubber pad or buffer 55 is attached to one side of casing 17A forming part of the support of sensing head 52 when mounted on a weaving machine. The piezoelectrical element 20B and the triboelectrical transducer system 50 each are connected to an individual pre-amplifier arranged in input circuit 7A'.

Normally sensing head 52 is pendently mounted on the weaving machine, the triboelectrical transducer system 50 being arranged at the lower end of sensing head 52.

Figure 16:
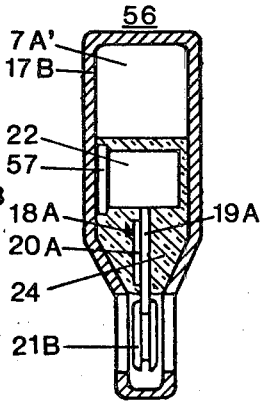
FIG. 16 represents a further thread sensing head having a combined transducer system, in similar cross-sectional view as FIG. 15.

FIG. 16 shows a sensing head 56 in which there are combined a high frequency tuned piezoelectrical transducer system 18A for providing the thread travel signal FL and a piezoresistive transducer system 57 for furnishing the thread tensioning signal FS. The upper end of sensing arm 19A is connected to block 22 in a similar manner as shown in FIG. 3, whereas the lower end of sensing arm 19A is fixedly attached to a ring-shaped thread guide 21B. Insofar, sensing head 56 is constructed analogously to the one shown in FIG. 3. Between the inner wall of casing 17B and block 22, ther is arranged a transducer system 57 which substantially consists of a soft elastic piezoresistive material whose electrical resistance is effected by mechanical load or change of shape. The piezoresistive transducer system 57 is connected to a D.C. voltage source by not shown connections, for enabling resistance measurement. Moreover, casing 17B is filled with soft elastic support material 24. The outputs of the two transducer systems 18A and 57 are each connected to an individual pre-amplifier fitted in an input circuit 7A'. Recent piezoresistive materials are known which are flexible and elastic and exhibit high pressure sensitivity.

Figure 17:
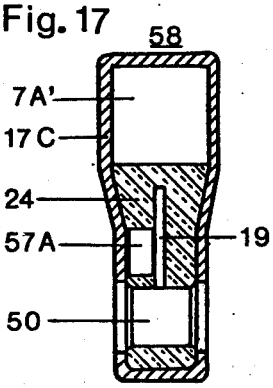
FIG. 17 shows another embodiment of a combined thread sensing head in cross-sectional view.

With reference to FIG. 17, sensing head 58 is fitted with a triboelectrical transducer system 50 and a piezoresistive transducer system 57A. Casing 17C is constructed in a similar manner as the casings represented by FIGS. 14–16. However, since there is not provided a block 22 in casing 17C, the perpendicular dimension of this casing 17C may be smaller than the one of casings 17A and 17B. Sensing arm 19 is embedded in a soft elastic support material 24, and one of the major faces of sensing arm 19 contacts piezoresistive transducer system 57A substantially consisting of soft elastic resistive material. The first triboelectrical transducer system 50 and the second piezoresistive transducer system 57A are individually connected with pre-amplifiers arranged in input circuit 7A'.

Figure 18:
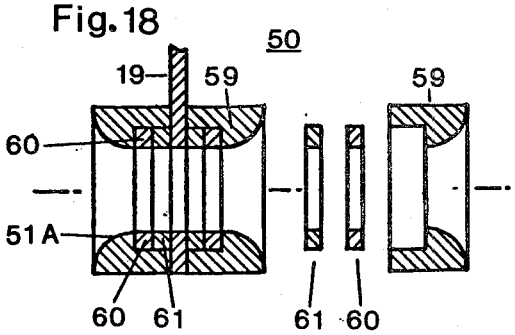
FIG. 18 is an axial cross-sectional view through a triboelectrical transducer system as shown in FIGS. 14, 15 and 17.

FIG. 18 shows the rotationally symmetric portion of transducer system 50 of FIGS. 12–15 and 17 in longitudinal or axial cross-section. It comprises two halves arranged in symmetrical relationship and cemented to sensing arm 19, one of these halves is shown at the right side in exploded view. Either half consists of three components, namely a ring-shaped ceramic thread guide 59, a ring electrode 60 and a spacing ring 61 made of insulating material. Sensing arm 19 is not only a support and component of the triboelectrical transducer system 50, but also serves as a ground electrode. The two ring electrodes 60 are interconnected by conducting means (not shown) to form a signal electrode which is connected to the input of a pre-amplifier comprised by the electonic signal circuit 7A'. When assembled, these components form, together with a circular bore in sensing arm 19, a thread passageway 51A receiving the weft or filling thread. Similar triboelectrical transducers which may be used here are described in the above cited Swiss Pat. No. 583,656.

By the new electronic monitor the failures inherent in known monitors are substantially eliminated. Thus, the new monitor meets all practical demands:

1. The main portion of yarn or thread breaks and transfer failures of the picking mechanism is safely detected in the first or insertion phase; the machine is stopped in an instant most suitable with respect to servicing and textile performance.

2. The remaining "thread breaks," i.e. late real thread breaks and all the "loosers" and "re-bounds" are seized when the weft thread is tensioned in the third phase, safely enough with respect to these relatively rare events. Generally, the machine is stopped when the threading-in means is still opened, and the few events which cause "overrunning" are negligeably seldom.

3. Oversize thread loops or coilings which occasionaly may occur prior to the catch box and cannot be eliminated by the thread tensioner are also classified as thread breaks, thus causing machine stops. This is desirable since otherwise there will arise so-called thread tails which cannot be inserted in the web and thus bring about defective selvedges.

4. Most components of the inventive monitors are identical with the corresponding parts of the above mentioned known electronic weft or filling thread monitor. Thus, the expense of structural elements is only slightly increased with the new monitors, and the manipulation thereof relatively simple.

While there are shown and described present preferred embodiments of the invention, it is to be distinctly understood that the invention is not limited thereto but may be otherwise variously embodied and practiced within the scope of the following claims.

Accordingly, what we claim is:

1. In a gripper shuttle weaving machine provided with means for picking the gripper shuttle, means for receiving and stopping the gripper shuttle at the end of each filling thread insertion, means for returning the gripper shuttle from a stop position into a defined thread releasing position, and means for tensioning the filling thread during the returning interval of the gripper shuttle, the improvement which comprises:

an electronic thread monitoring device comprising means arranged at the picking side of the weaving machine for sensing the filling thread and producing a first signal indicative of thread travel and a second signal indicative of thread tensioning;

sensing means comprising at least one transducer system generating a first high frequency signal indicative of thread travel and a second low frequency signal indicative of thread tensioning during said returning interval;

means actuated by the weaving machine for generating a first timing pulse within the filling thread insertion interval, and a second timing pulse within said returning interval; and gating means controlled by said first and second signals and first and second timing pulses, for generating a stop signal when no first or second signal exists during the first and second timing pulses, respectively.

2. The electronic thread monitoring device as defined in claim 1, wherein:

said sensing means further comprises an electronic signal circuit comprising first means for handling said first high frequency signal, and second means for handling said second low frequency signal.

3. The electronic thread monitoring device as defined in claim 1, wherein:

said sensing means comprises first and second transducer systems mechanically coupled with each other, the first transducer system generating a high frequency signal indicative of thread travel, and the second transducer system producing a low frequency signal indicatve of increasing thread tension upon tensioning of the filling thread within said returning interval.

4. The electronic thread monitoring device as defined in claim 3, wherein:

either of said first and second transducer system comprises a sensing lever and a piezoelectrical element fixedly attached thereto, and a rigid block, one end of the sensing lever being attached to the rigid block, whereas the free ends of the sensing levers are coupled to common thread guide means.

5. The electronic thread monitoring device as defined in claim 3, wherein:

said sensing means comprises a rigid block;

said first transducer system comprising a triboelectrical transducer attached to the other free end of the sensing lever, and the second transducer system comprising a piezoelectrical element fixedly attached to one of the major faces of the sensing lever.

6. In a gripper shuttle weaving machine provided with means for picking the gripper shuttle, means for receiving and stopping the gripper shuttle at the end of each filling thread insertion, means for returning the gripper shuttle from a stop position into a defined thread releasing position, means for tensioning the filling thread during the returning interval of the gripper shuttle, thread braking means disposed upstream of the picking means, the weft tensioning means being disposed between the thread braking means and the picking means, the improvement which comprises:

an electronic thread monitoring device comprising thread sensing means located between said thread braking means and filling thread tensioning means for sensing the filling thread and producing a first signal indicative of thread travel and a second signal indicative of thread tensioning;

means actuated by the weaving machine for generating a first timing pulse within the filling thread insertion interval, and a second timing pulse within said returning interval; and gating means controlled by said first and second signals and first and second timing pulses, for generating a stop signal when no first or second signal exists during the first and second timing pulses, respectively.

* * * * *